United States Patent [19]

Sato et al.

[11] 4,056,395

[45] Nov. 1, 1977

[54] METHOD FOR PRODUCING A RELIEF PATTERN BY ION-ETCHING A PHOTOGRAPHIC SUPPORT

[75] Inventors: Masamichi Sato; Keishiro Kido; Noboru Arai, all of Asaka, Japan

[73] Assignee: Fuji Photo Film Co., Ltd., Minami-ashigara, Japan

[21] Appl. No.: 633,199

[22] Filed: Nov. 19, 1975

[30] Foreign Application Priority Data

Nov. 19, 1974 Japan ..... 49-132897

[51] Int. Cl.[2] ..... G03C 5/00

[52] U.S. Cl. ..... 96/36; 96/27 H; 156/643; 156/654; 156/655; 156/659; 204/192 E; 204/192 EC

[58] Field of Search ..... 96/36, 50, 35.1, 27 H; 156/7, 643, 654, 655, 659; 204/192 E, 192 EC, 129.1

[56] References Cited

U.S. PATENT DOCUMENTS

| | | | |
|---|---|---|---|
| 3,576,630 | 4/1971 | Yanagawa | 96/36 |
| 3,639,125 | 1/1969 | Chand | 96/35 |
| 3,664,942 | 5/1972 | Hauas et al. | 204/192 |
| 3,733,258 | 5/1973 | Hanak et al. | 204/192 E |
| 3,782,940 | 1/1974 | Ohto | 96/35.1 |
| 3,849,135 | 11/1974 | Karcikowski et al. | 96/36 |
| 3,860,783 | 1/1974 | Schmidt et al. | 204/192 E |
| 3,873,361 | 3/1975 | Franco et al. | 204/192 EC |

*Primary Examiner*—Edward C. Kimlin

*Attorney, Agent, or Firm*—Sughrue, Rothwell, Mion, Zinn and Macpeak

[57] ABSTRACT

A method for producing a relief pattern comprising forming one of (i) a silver image, (ii) a silver halide image, or (iii) an image obtained by toning and/or intensifying the silver image or silver halide image, in the emulsion layer of a photographic light-sensitive material which comprises a support having thereon at least one silver halide emulsion layer, either directly or on at least one subbing layer on the support, by image-wise exposing to light and developing, heating the photographic material to decompose the binder of the emulsion layer, and then ion-etching the photographic material to form a relief pattern of the support corresponding to the above-described image.

12 Claims, No Drawings

METHOD FOR PRODUCING A RELIEF PATTERN BY ION-ETCHING A PHOTOGRAPHIC SUPPORT

BACKGROUND OF THE INVENTION

1. FIELD OF THE INVENTION

The present invention relates to a method for producing a relief pattern.

2. DESCRIPTION OF THE PRIOR ART

Heretofore, a relief pattern of glass or a semiconductor has been made by a process where a photoresist layer coated on a glass or semiconductor support is image-wise exposed to light and developed to uncover the surface of the support at the exposed or unexposed areas, the support at uncovered areas is then etched, and then the remaining resist at non-exposed or exposed areas is removed to obtain a relief pattern of the support. The above described process is called photoetching. Relief patterns obtained by photoetching possess a uniform height (thickness).

However, some uses require a relief having a height which gradually (continuously) varies. For example, an optical guide which is used as an element for an optical IC (Integrated Circuit) usually has a uniform rectangular section; however it is preferred that one end of the guide be tapered when the guide is connected to other elements at that end. It is difficult to form such a tapered relief pattern using conventional photoetching.

Further, a phase hologram of the relief type is desired to have a continuously changing relief. However, in a relief type phase hologram obtained by conventional photoetching it is difficult to change the height of the relief in a continuous manner, i.e., photoresists reproduce continuous gradation only with difficulty, accordingly when a hologram is formed using photoetching, the cross-section of the relief obtained varies in an abrupt, discontinuous fashion. Therefore, the physical-/optical characteristics of a relief type phase hologram obtained by photoetching have been unsatisfactory.

Moreover, conventional photoetching has the disadvantage that the light-sensitivity of photoresists is low. In addition, conventional photoetching requires chemical processes such as coating of a photoresist, developing, chemical etching, removal of photoresist, and, accordingly, conventional photoetching results in environmental pollution through the discharge of used chemicals.

Heretofore, emulsion holograms (amplitude holograms obtained by exposing and developing a silver halide emulsion layer formed on a support, and phase holograms obtained by bleaching such an amplitude holograms) have been used as amplitude holograms in which an image is recorded as black and white stripes (black stripes comprise silver grains) and as phase holograms obtained by bleaching such amplitude holograms. Since amplitude holograms have a low diffraction efficiency, the silver grains are often bleached and converted into silver halides or other transparent silver compounds to obtain a so-called emulsion phase hologram having a higher diffraction efficiency.

However, such emulsion phase holograms have the defect that the silver compound in the hologram is colored by print-out during use, and the diffraction efficiency thereof decreases, i.e., the light resistance of the hologram is low.

Further, emulsion phase holograms have the defect that since the binder of the holograms is an organic material, such as gelatin, the heat resistance is low, i.e., water-soluble polymers which can be used as binders for photographic emulsions color when heated to about 150° C, therefore it has been difficult to use emulsion holograms at a temperature higher than about 150° C.

Heretofore, it has been known to produce relief type phase hologram by frost xerography using a thermoplastic polymer. However, the apparatus to produce such a relief type phase hologram is complicated, and the phase hologram obtained has poor light, heat and abrasion resistance, and further has the defect that the physical/optical characteristics are poor since a relief having a continuous gradation is not obtained.

SUMMARY OF THE INVENTION

It is, therefore, one object of the present invention to provide a novel method for producing a relief pattern in a support itself (that is, the relief consists of the material of the support).

Another object of the present invention is to provide a novel method for producing a relief pattern having continuous gradation.

A further object of the present invention is to provide a method for producing a relief pattern which includes less chemical processings.

A still further object of the present invention is to provide a method for producing a phase hologram having good light resistance and heat resistance.

The above-described objects of the present invention are attained by exposing and developing a silver halide emulsion layer formed on a support to form one of (i) a silver image, (ii) a silver halide image, or (iii) an image obtained by toning and/or intensifying the silver image or silver halide image, heating (hereinafter designated "baking") the emulsion layer to decompose the binder of the emulsion layer, and then ion-etching the emulsion layer and the support to form a relief image of the support corresponding to the above-described image.

DETAILED DESCRIPTION OF THE INVENTION

The silver halide emulsions used in the present invention are conventional, and can be obtained by dispersing and silver halide in any water-soluble binder. Illustrative silver halides are silver chloride, silver bromide, silver iodide, silver chlorobromide, silver chloroiodide, silver bromoiodide, silver chlorobromoiodide, and mixtures thereof.

A typical silver halide emulsion is an emulsion which contains about 90 mol% or more silver bromide (preferably containing not more than about 5 mol% silver iodide) and contains silver halide grains of a mean grain size of not more than about 0.1 $\mu$ (a so-called Lippmann emulsion), and in which the weight ratio of silver halide to the water-soluble binder is about 1:4 to about 6:1. Another example of a typical silver halide emulsion is an emulsion which contains about 50 mol% or more (preferably 70 mol%) silver chloride and contains silver halide grains of a mean grain size of not more than about 1.0 $\mu$.

Examples of water-soluble binders which can be used include gelatin (alkali treated gelatin, acid treated gelatin enzyme treated gelatin), colloidal albumin, casein, cellulose derivatives (e.g., carboxymethyl cellulose, hydroxyethyl cellulose, etc.), saccharide derivatives (e.g., agar-agar, sodium alginate, starch derivative, etc.), synthetic hydrophilic high molecular weight colloids (e.g., polyvinyl alcohol, poly-N-vinyl pyrrolidone, polyacrylic acid copolymers, polyacryamide, derivatives thereof, etc.). If desired, a compatible mixture of two or more of these binders can be used. Of these, a most preferred binder is gelatin which can be replaced, partly or completely, by a synthetic high molecular weight substance, by a gelatin derivative (prepared by processing gelatin with a compound having a group capable of reacting with the functional groups contained in the gelatin molecule (i.e., amino groups, imino groups, hydroxy groups or carboxy groups), or by a graft polymer prepared by grafting a molecular chain of another high molecular weight substance onto gelatin. Suitable compounds for preparing the gelatin derivatives are isocyanates, acid chlorides and acid anhydrides as described in U.S. Pat. No. 2,614,928, acid anhydrides as described in U.S. Pat. No. 3,118,766, bromoacetic acids as described in Japanese Patent Publication No. 5514/64, phenyl glycidyl ethers as described in Japanese Patent Publication No. 21845/67, vinyl sulfone compounds as described in U.S. Pat. No. 3,132,945, N-acrylvinyl-sulfonamides as described in British Pat. No. 861,414, maleinimide compounds as described in U.S. Pat. No. 3,186,846, acrylonitriles as described in U.S. Pat. No. 2,594,293, polyalkylene oxides as described in U.S. Pat. No. 3,312,553, epoxy compounds as described in Japanese Patent Publication 26845/67, acid esters as described in U.S. Pat. No. 2,763,639, alkanesultones as described in British Pat. No. 1,033,189, and the like. Examples of suitable branched high molecular weight polymers grafted onto gelatin are given in U.S. Pat. Nos. 2,763,625; 2,831,767; 2,966,884; *Polymer Letters,* 5, 595 (1967); *Photo Sci. Eng.,* 9, 148 (1965); *J. Polymer Sci. A*-1, 9, 3199 (1971), and the like.

Homopolymers or copolymers of compounds which are generally called vinyl monomers, such as acrylic acid, methacrylic acid, and esters thereof, amide, and nitrile derivatives thereof, styrene, etc., are widely used. Hydrophilic vinyl polymers having some compatibility with gelatin, such as homopolymers or copolymers of acrylic acid, acrylamide, methacrylamide, hydroxyalkyl acrylate, hydroxyalkyl methacrylate, etc., are particularly preferred.

The silver halide emulsions are advantageously optically sensitized with known optical sensitizers such as the cyanine dyes and merocyanine dyes as described in U.S. Pat. Nos. 1,346,301; 1,846,302; 1,942,854; 1,990,507; 2,493,747; 2,739,964; 2,493,748; 2,503,776; 2,519,001; 2,666,761; 2,734,900; 2,739,149; and British Pat. No. 450,958.

The silver halide emulsion layer can be suitably exposed to electromagnetic radiation to which the silver halide emulsion therein is sensitive, e.g., visible, ultraviolet, electron beams, X-rays, etc. With optically sensitized photographic light-sensitive materials, it is convenient to select light mainly having a wavelength corresponding to the optically sensitized region of the emulsion as the light for exposing the emulsion layer.

The emulsion is advantageously chemically sensitized with a salt of a noble metal such as ruthenium, rhodium, palladium, iridium, platinum, etc., as described in U.S. Pat. No. 2,448,060; 2,566,245; and 2,566,263. Also, the emulsion can be chemically sensitized with a gold salt as described in U.S. Pat. No. 2,339,083. The emulsion can be stabilized and fog-inhibited with a gold salt as described in U.S. Pat. No. 2,597,856 and 2,597,915, furthermore, the thiopolymers as described in U.S. Pat. No. 3,046,129 can advantageously be incorporated into the emulsion. In addition, the emulsion can be stabilized and fog-inhibited with mercury compounds as described in U.S. Pat. No. 3,046,129, column 20, line 51 to column 21, line 3, triazoles, azaindenes, disulfides, quaternary benzothiazolium compounds, zinc salts and cadmium salts.

The emulsion can contain light-absorbing dyes as described in U.S. Pat. Nos. 2,527,583; 2,611,696; 3,247,127; 3,260,601; etc., if desired.

The emulsion is advantageously hardened with a suitable hardening agent for hydrophilic colloids such as formaldehyde or a like hardener; halogen-substitued fatty acids such as mucobromic acid; compounds having a plurality of acid anhydride groups; methansulfonic acid bisester; dialdehydes or the sodium bisulfite adducts thereof such as $\beta$-methylglutaraldehyde bissodium bisulfite; bisaziridinecarboxyamides such as trimethylene-bis(1-aziridinecarboxyamide); triazine derivative such as 2-(hydroxy-4,6-dichloro-s-triazone); and the like.

The silver halide emulsion can be coated on a support per se or coated after adding a coating aid as described in U.S. Pat. No. 3,046,129, if desired. The silver halide emulsion layer can have a dry thickness of about 0.3 to 20 $\mu$; however, the thickness of the emulsion layer can be properly selected depending upon the end use of the relief pattern. The silver halide emulsion layer can be coated in one or more layers on one or both surfaces of the support.

If desired, a conventional backing layer, antihalation layer, interlayer, uppermost layer (e.g., a protective layer, etc.), subbing layer, and the like can be provided on the support or the emulsion layer.

In the present invention a subbing layer is often used. The subbing layer thickness is usually about 0.01 to 1 $\mu$, preferably about 0.02 to 0.5 $\mu$ (dry thickness). Water-soluble materials as described for the water-soluble binders can be used as a subbing layer.

The formation of a silver image in the silver halide emulsion layer can be effected using conventional photographic processings, that is, by development-processing the exposed emulsion layer and, if necessary, fixing. For example, in normal development, developing and fixing are necessary, but in reversal development, fixing is not necessary. Conventional photographic processings including exposure, development, fixing, etc., which can be used are described in detail in "Techniques of Microphotography" *Kodak Data Book P*-52. Eastman Kodak Co., Rochester, N.Y.

The developing agents which can be used for forming silver images in the method of the present invention are conventional and include developing agents such as dihydroxybenzenes and polyhydroxybenzenes (e.g., hydroquinone, 2-chlorohydroquinone, 2-bromohydroquinone, 2-isopropylhydroquinone, toluhydroquinone, 2-phenylhydroquinone, 2,3-dichlorohydroquinone, 2,5-dimethylhydroquinone, pyrogallol, etc.), 3-pyrazolidones (e.g., 1-phenyl-3-pyrazolidone, 1-phenyl-4-methyl-3-pyrazolidone, 1-phenyl-4,4-dimethyl-3-pyrazolidone, 1-phenyl-4-ethyl-3-pyrazolidone, 1-phenyl-5-methyl-3-pyrazolidone, etc.), aminophenols (e.g., o-aminophenol, p-aminophenol, o-(methylamino)-phenol, p-(methylamino)phenol, p-(diethylamino)-phenol, 2,4-diaminophenol, p-(benzylamino)phenol, etc.), ascorbic acid, 1-aryl-3-aminopyrazolines (e.g., 1-(p-hydroxyphenol)-3-aminopyrazoline, 1-(p-methylaminophenyl)-3pyrazoline, 1-(p-aminophenyl)-3-pyrazoline, 1-(p-amino-m-methylphenyl)-3-aminopyrazoline, etc.), N-(p-hydroxyphenyl)glycine, the compounds described as developing agents in C. E.

K. Mees & T. H. James, *The Theory of the Photographic Process,* 3rd Edition, Chapter 13, Macmillan Co., New York (1966), L.F.A. Mason *Photographic Processing Chemistry,* pp. 16 to 30, The Focal Press, London (1966), and mixtures thereof. The developer generally possesses a pH of not less than about 8, preferably about 8.5 to about 12.5.

The developer can contain, if desired, conventional additives such as an alkali agent (e.g., an alkali metal or ammonium hydroxide, carbonate, borate, etc.), a pH-adusting agent or buffer (e.g., a weak acid or alkali such as acetic acid, boric acid, or d salt thereof, etc.), a development promoting agent (e.g., a pyridinium compound and cationic compound as described in U.S. Pat. Nos. 2,648,604 and 3,671,247, potassium nitrate, sodium nitrate, condensation products of polyethylene glycol and derivatives thereof as described in U.S. Pat. Nos. 2,533,990; 2,577,127; and 2,950,970, nonionic compounds such as polythioethers represented by the compounds as described in British Pat. Nos. 1,020,033 and 1,020,032, pyridine, organic amines such as ethanolamine, benzyl alcohol, hydrazines, etc.), an antifogging agent (e.g., an alkali bromide, alkali iodide, nitrobenzimidazoles as described in U.S. Pat. Nos. 2,496,940 and 2,656,271 and mercaptobenzimidazole, 5-methylbenzotriazole, 1-phenyl-5-mercaptotetrazole, compounds for forming a rapid developing solution as described in U.S. Pat. Nos. 3,113,864; 3,342,596; 3,295,976; 3,615,522; and 3,597,199, thiosulfonyl compounds as described in British Pat. No. 972,211, phenazine-N-oxides as described in Japanese Patent Publication No. 41675/71, an antifogging agent as described in *Kagaku Shashin Binran* (*Handbook of Scientific Photography*), Vol. 2, pp. 29 to 47, Maruzen, Tokyo (1959), a stain or sludge-preventing agent as described in U.S. Pat. Nos. 3,161,513 and 3,161,514 and in Pat. Nos. 1,030,442; 1,144,481; and 1,251,558, a preservative (e.g., a sulfite, an acid sulfite, hydroxyaline hydrochloride, formaldehyde-sulfite adduct, ethanolamine-sulfite adduct, etc.), a surface active agent, and the like.

The fixing agents for the silver halide are conventional and include all the generally well known solvents for silver halide, such as a water-soluble thiosulfate (e.g., potassium thiosulfate, sodium thiosulfate, ammonium thiosulfate, etc.), a water-soluble thiocyanate (e.g., potassium thiocyanate, sodium thiocyanate, ammonium thiocyanate, etc.), a water-soluble organic diol (e.g., 3-thia-1,5-pentanediol, 3,6-dithia-1,8-octanediol, 3,6,9-trithia-1,11-undecanediol, 3,6,9,12-tetrathia-1,14-tetradecanediol, etc.), a water-soluble sulfur-containing organic dibasic acid (e.g., ethylenebisthioglycolic acid, etc.), a water-soluble salt thereof (e.g., potassium ethylenebisthioglycolate, sodium ethylenebisthioglycolate, etc.), and a mixture thereof.

The fixing agent containing solution can contain, if desired, a preservative (e.g., a sulfite, a bisulfite, etc.), a pH-buffer (e.g., boric acid, a borate, etc.), a pH-adjusting agent (e.g., acetic acid, etc.), a chelating agent, and the like.

Suitable supports include glass (e.g., silica glass, borosilicate glass, soda lime glass, barium glass, etc.), ceramics (e.g., hard porcelain, soft porcelain, alumina porcelain, titanium porcelain, beryllia porcelain, mullite porcelain, talc porcelain, spinel porcelain, zircon porcelain, ferrite porcelain, earthenware, including glazed and baked earthenware (earthenware is generally consider water-porous whereas porcelains are non-porous), etc.), cermets, silica, sapphire, quartz, semi-metals )e.g., silicon, germanium, Ga-As, Ga-P, In-P, etc.), metals (e.g., iron, copper, zinc, zntimony, nickel, cobalt, aluminum, titanium, chromium, tungsten, molybdenum, gold, platinum, palladium, iridium, rhodium, ruthenium, zirconium, tantalum, hafnium, etc.), alloys (e.g., iron alloys, aluminum alloys, copper alloys, magnesium alloys, nickel alloys, etc.), porcelain enamel, metals coated with ceramics, metals having an oxide layer thereon, heat resistant high melting point polymers (having a melting (or degrading) temperature range of about 250° to about 550° C, preferably about 350° to about 550° C) such as poly (pyromellitec acid-p-phenylenediamineimide), poly(p-oxybenzoate), poly(ethylene-2,6-naphthalate), polyamidoimide polymers as described in U.s. Pat. No. 3,554,984, polyimidoimine polymers as described in U.S. Pat. No. 3,477,815, etc. or a combination of two or more thereof.

The substrate of the present invention is, in general, dimensionally stable before and after baking. However, a high degree of dimensional stability is not always required, as such will depend on the end-use of the relief image.

The substates of the present invention must be resistant to heat (not deform or degrade) of at least 200° C, preferably at least 300° C.

The above-described supports for the present invention may be transparent or opaque, and can be freely selected depending on the end-use or objects of the photographic element.

The silver halide emulsion layer is subjected to imagewise exposure using particle rays or electromagnetic radiation to which the silver halide emulsion is sensitive, e.g., electron beams, anode rays, ultraviolet light, visible light, near infrared light, X-rays, etc. Of these, electron beams or electromagnetic waves ranging from 290 mm to 800 mm are particularly suitable. Methods for image exposure are described, for example, in R. J. Collier, C. B. Bruckhardt & L. H. Lin, *Optical Holography,* Chapter 7, Academic Press (1971) and H. M. Smith, *Principles of Holography,* Chapters 2 and 6, Wiley-Interscience (1969), etc.

The general, at least developing is necessary after exposure and before baking.

Thus, a silver image or silver halide image is formed in the silver halide emulsion layer. The emulsion layer is then baked to thermally decompose the binder of the emulsion layer. Baking can be effected by heating in an atmosphere of air or other gas such as an inert gas (e.g., nitrogen, argon, etc.), a hydrocarbon (e.g., $CH_4$, etc.), a halogenated hydrocarbon (e.g., $CCl_4$, $CCl_2F_2$, etc.), etc., or in a vacuum where the degree of vacuum is not limited. Of these, the most convenient atmosphere is air. The binder is decomposed in both image and non-image areas. Decomposed binder is substantially colored but non-decomposed binder is not substantially colored, namely, it is substantially clear and substantially coloress.

A suitable baking temperature is not less than about 150° C and not more than the softening point of the support, more preferably not less than about 300° C, and the upper limit is about 600° C or the softening point of the support when the softening point of the support is lower than 600° C. There is no limitaton on the pressure used, and any pressure obtainable can be employed. The baking time mainly depends on the temperature used. If a temperature around the lower limit is employed, very long periods of time will be necessary, i.e., about 2 - 3 hours, but if a temperature around the upper limit is employed, only about 1 to 2 minutes is sufficient.

After the baking, the emulsion layer is ion-etched. The term "ion-etching" as used herein in the present invention designates the procedure of bombarding ions of high energy against a substance so that the substance bombarded is removed. (See R. G. Wilson & G. R. Brewer, *ION BEAMS with Application to Ion Implanatation,* pp. 317 to 335, John Wiley & Sons (1973) and L. I. Maissel & R. Glang, *Handbook of Thin Film Technology,* pp. 7 to 49 – 7 to 53, McGraw-Hill (1971).) One example of ion-etching is cathode sputtering. Other examples are r.f. sputtering and ion beam etching. It is thus clear from the principle of the present invention that the ion-bombarding technique employable in the present invention is not limited only to sputtering. Needless to say, any conventional ion-bombarding technique which can cause removal of the substance bombarded can be employed. Therefore, cathode sputtering is only one example of the ion-etching of the present invention to preferentially remove the non-image areas from a photographic material.

It has heretofore been found that the rate at which non-silver image areas or non-silver halide image areas are ion-etched or sputter-etched is greater than the rate in the image areas, and a method for producing a photomask using this phenomenon is described in Japanese Patent Application OPI 70007/75. In this method, a silver image is formed by exposing and developing a photographic material which comprises a support having thereon a masking layer and a silver halide emulsion layer on the masking layer, the photographic material is then ionetched to uncover the masking layer at the non-image areas, and then the uncovered masking layer is removed by etching. The above-described method does not include a conception of producing a relief pattern having continuous gradation. Further, in the present invention a masking layer is not used.

It has been discovered that if the emulsion layer is heated to thermally decompose the binder of the emulsion layer before ion-etching, the etching rate of the binder at the non-image areas is greatly increased and, further, the edge of the image obtained by ion-etching becomes extremely smooth and provides high contrast.

It has been found that if a silver image having continuous gradation is continually ion-etched after the thermally decomposed binder at the non-image areas is removed and the surface of the support is uncovered by ion-etching, the support at the non-image areas is etched in a uniform depth, and the support at the image areas is etched to various depths which are dependant on image density, that is, the smaller the image density is, the deeper the support is etched. The depth of etching is roughly inversely proportional to the image density. As a specific example, when ion-etching is continued until the emulsion at the maximum image density is just removed, almost no substance comprising the image remains on the support relief obtained, and accordingly, a removal step (which can be called resist removal) of remaining substance can be omitted. When ion-etching is stopped at about half way to "remaining substance" removal, substances comprising the image remain on the relief pattern; however, the remaining substances are not disadvantageous for some purposes, e.g., when the resultant image is used as a transparent image.

The method of the present invention can be applied to the production of heat resistant and light resistant holograms. For example, a silver halide photographic emulsion layer formed on a transparent glass support can be exposed to coherent light and then developed to obtain a so-called amplitude hologram. The thus obtained amplitude hologram is baked as earlier described to thermally decompose the binder of the emulsion layer, and then ion-etched to preferentially remove the binder at the non-silver image or non silver-halide image areas of the hologram. By subsequent ion-etching, the sections of the uncovered glass support are etched, but the glass support at the silver image areas is not etched since the silver grains and the thermally decomposed binder at the silver image areas mask the support against ion-etching. By further ion-etching, the glass support at the non-silver image areas is etched deeper, and the emulsion layer at the silver image areas is also etched to decrease the thickess thereof, until finally the emulsion layer at the silver image areas will be completely removed. If ion-etching is discontinued at this stage, a phase hologram having a glass relief pattern with continuous gradation (that is, the height of the relief changes continuously) corresponding to the black and white fringe of the amplitude hologram is obtained. The thus obtained phase hologram possesses high diffraction efficiency, heat resistance, light resistance and abrasion resistance, and accordingly, can be used as a die for the mass production of plastic holograms (reliefs formed with plastics), for example, a melt of a resin is coated thereon and dried and then peeled therefrom. Hereinafter, a phase hologram having a glass relief of the present invention is designated a "glass hologram".

Instead of the silver image as described above, a silver halide image can be used. That is, when silver halide exists in the emulsion layer, the ion-etching rate of the emulsion layer at the silver halide areas is small as compared with the ion-etching rate of the emulsion layer at the non-silver halide areas. Fixing is, of course, not required in this embodiment.

A silver halide image can be formed, for example, as follows. The silver image obtained by exposing and developing the silver halide emulsion layer is bleached with a bleaching solution containing dichromate ions and sulfuric acid to remove the image bearing silver and to leave silver halide at the nonexposed areas. At the exposed areas no silver or silver compound exists. The thus obtained silver halide image is a type of reversal image. In a conventional reversal development, this silver halide is developed to form a reversal silver image; however, in the present invention such is not always necessary. The thus obtained silver halide image is baked to thermally decompose the binder of the emulsion layer, and then subjected to ion-etching in accordance with the present invention.

In general, a first development is always necessary in this invention. For the case of reversal development such is usually followed by a second development after uniform exposure. However, in the present invention a silver halide image can be used instead of a silver image. Therefore, the second development is not always necessary, as opposed to a first development. Imagewise exposure is never directly followed by baking in the present invention.

Before the emulsion layer is baked, the silver or silver halide image can be intensified and/or toned (hereinafter designated as intensification for simplicity) using known methods to add other substances thereto or to convert the silver image or silver halide image into an image of another substance. As a result, the etching rate of the emulsion layer at the image areas decreases, and, accordingly, the depth of the relief pattern can be increased. The above-described fact is particularly important when a glass phase hologram of the present invention is obtained. That is, since the image contrast of the fringe of an amplitude hologram is in general small, the depth of the relief pattern is apt to become small when an amplitude hologram is converted into the glass phase hologram by ion-etching process. However, the depth of the relief pattern can be increased by increasing the image contrast of the fringe of the amplitude hologram using intensification.

General descriptions of intensifications are given, for example, in Pierre Glafkides, Photographic Chemistry, Vol. 1, pp. 189–199 and Vol. 2 p. 643–662, Fountain Press, London (1958).

Examples of preferred intensifications or tonings are mercury intensification, copper intensification, lead intensification, uranium toning, selenium toning, sulfur toning, iron toning, nickel toning, cobalt toning, copper toning, vanadium toning, titanium toning, lead chromate toning, cadmium toning, noble metal toning, etc.

Of these, vanadium toning, titanium toning, iron toning, nickel toning, cobalt toning, copper toning, gold toning, rhodium toning, palladium toning and lead chromate toning are particularly preferred, as the ion-etching rate of the substances added or formed by these intensifications are relatively small.

By intensification, the silver image is converted into a mixture of silver and another compound, or a mixture of a silver compound and another compound, or another compond without silver. Any of these images can be used for the method of the present invention.

The emulsion layer remaining on the relief pattern after ion-etching can be removed by swelling or dissolving with a swelling agent or solvent therefor. For example, the removal of the emulsion layer can be effected using an alkali (e.g., an aqueous solution of sodium hydroxide or potassium hydroxide at a concentration of about 10 to 20 wt% at about 40° to 60° C for about 2 to 10 min., etc.), an acid (e.g., concentrated sulfuric acid (98 wt%) at about 60° to 95° C for about 2 to 10 min., or concentrated nitric acid (70 wt.%) at about 60° to 95° C for about 2 to 10 min., etc.), or a salt (e.g., an aqueous solution of sodium hypochlorite or potassium hypochlorite at a concentration of 4 to 10 wt% at about 20° to 50° C for about 2 to 10 min., etc.).

The following examples are given to illustrate the present invention in greater detail. Unless otherwise indicated, all parts, percents, ratios and the like are by weight.

EXAMPLE 1

1400 ml of a silver bromide emulsion (mean grain size of silver bromide: about 0.06 $\mu$) was prepared using 50 g of gelatin and 188 g of silver bromide. To this emulsion was added 0.25 g of 5-[2-(3-methylthiozolinyliden-)ethylidene]-3-carboxymethylrhodanine to optically sensitize the emulsion to light of a wavelength of 510 to 530 m$\mu$. The emulsion was then coated to obtain a dry thickness of about 6 $\mu$ on a soda lime glass plate, and then dried to obtain a light-sensitive photographic material.

This photographic material was simultaneously exposed to two argon ion laser beams (wave length: 5145 A) having a cross angle of about 15°, and then developed in a developer having the following composition (24° C, 5 min.), followed by fixing in a fixing solution having the following composition (24° C, 1 min.) to obtain an amplitude hologram.

| | | |
|---|---|---|
| Developer | | |
| 1-Phenyl-3-pyrazolidone | 0.5 | g |
| Sodium Sulfite | 50 | g |
| Hydroquinone | 12 | g |
| Sodium Carbonate (monohydrate) | 60 | g |
| Potassium Bromide | 2 | g |
| Benzotriazole | 0.2 | g |
| 1-Phenyl-5-mercaptotetrazole (0.1 wt.% aqueous solution) | 5 | ml |
| Phenazine-2-carboxylic acid | 1 | g |
| Water to make | 1 | liter |
| Fixing Solution | | |
| Ammonium Thiosulfate (70 wt.% aqueous solution) | 200 | ml |
| Sodium Sulfite | 15 | g |
| Boric Acid | 8 | g |
| Glacial Acetic Acid | 16 | ml |
| Aluminum Sulfate | 10 | g |
| Sulfuric Acid | 2 | ml |
| Water to make | 1 | liter |

The thus obtained amplitude hologram was heated to about 400° C for about 10 min. and then subjected to RF sputter etching in argon using an RF sputtering apparatus (model "FP-46"; made by Nippon Electric Varian Co., Ltd.). The conditions of sputter eching were as follows: frequency: 13.56 MHz; high frequency power: 500 W; gas pressure: $1.2 \times 10^{-2}$ Torr (argon). The amplitude hologram was placed on a silica plate having a thickness of 5 mm on a stainless steel cathode with the emulsion layer up side for the RF sputtering.

With these conditions, sputter etching was carried out for about 10 min., and the emulsion layer at the non-image areas (non-silver areas of the fringe) was almost completely removed (about 0.05 82 remained) but the emulsion layer at the silver image areas (silver areas of the fringe) was removed in only a small amount (about 0.2 $\mu$ remained). By a subsequent sputter etching for about 10 min., the emulsion layer at the silver image areas was almost completely removed (about 0.1 $\mu$ remained), and a relief pattern of glass corresponding to the silver fringe was formed on the surface of the glass support.

The thus obtained phase glass hologram possessed a diffraction efficiency of about 11%, was light resistant, heat resistant, and stable (did not degrade) for long periods of time.

EXAMPLE 2

The same procedures as described in Example 1 were followed except for changing the sputtering gas from argon to air and the sputtering time from 20 min. to about 40 min.

The diffraction efficiency of the thus obtained phase hologram was about 10%.

EXAMPLE 3

The amplitude hologram obtained in Example 1 was immersed in a 0.3 wt.% aqueous solutio of chloroauric acid at 20° C for about 2 min. before baking to convert the silver image into a mixture of silver chloride and gold. After rinsing in water, the silver chloride present was converted into silver using the developer at the conditions as described in Example 1, and then rinsed in water and dried. The baking process and the subsequent procedures as described in Example 1 were conducted except for increasing the sputtering time to about 35 min.

The diffraction efficiency of the thus obtained phase hologram was about 13%.

EXAMPLE 4

The same procedures as described in Example 3 were followed except for using rhodium (III) chloride (0.3 wt.% aqueous solution) instead of chloroauric acid and increasing the sputtering time to about 40 min.

The diffraction efficiency of the thus obtained phase glass hologram was about 15%.

EXAMPLE 5

The amplitude hologram obtained in Example 1 was toned before baking using a toning solution having the following composition (20° C, 25 min.).

| Toning Solution | |
|---|---|
| 20 wt. % Aqueous Vanadium Citrate Solution | 50 ml |
| Citric Acid (saturated aqueous solution) | 50 ml |
| Saturated Aqueous Ammonium Alum Solution | 50 ml |
| 20 wt. % Aqueous Ferric Citrate Solution | 100 ml |
| Glycerin | 50 ml |
| 10 wt. % Aqueous Potassium Ferricyanide Solution | 10 ml |
| Water to make | 1 liter |

After rinsing in water and drying, the photographic material was heated in air at about 400° C for about 5 min., and then sputter etched for about 45 min. in the same manner as described in Example 1.

The diffraction efficiency of thus obtained phase glass hologram was about 15%.

EXAMPLE 6

Onto the silica plate on the cathode of the sputtering apparatus of Example 1 a uniform mixture of a silver powder and a glass powder was coated in a thickness of about 2 mm (particle size of the silver powder: 300 – 2000 mesh; particle size of the glass powder: 400 – 2000 mesh; ratio of the silver powder to the glass powder: about 1:2 by volume), and a soda lime glass plate 1.6 mm thick was placed under the anode (the smaller the distance, the better). Using the same conditions as described in Example 1, sputtering was carried out for about 15 min. to form an orange colored glass layer about 0.4 $\mu$ thick on the soda-lime glass plate.

On the thus obtained colored glass layer there was coated the same emulsion as described in Example 1 to obtain a photographic material (dry thickness of the emulsion layer: about 5 $\mu$).

The thus obtained photographic material was exposed to an image having continuous gradation and developed in the same manner as described in Example 1 to obtain a silver image having continuous gradation. The photographic material was then baked in air at 400° C for about 5 min. and then subjected to sputter etching for 20 min. as described in Example 1 to obtain a colored glass photograph having continuous gradation corresponding to the silver image (a negative of the silver image).

The thus obtained photograph was heat, light, reagent and moisture resistant, and accordingly, could serve as a permanent photograph.

EXAMPLE 7

The same procedures as described in Example 6 were carried out except for using a vacuum deposited gold layer about 0.1 $\mu$ thick instead of the colored glass layer and decreasing the sputtering time to about 16 min.

A permanent gold photographic image having continuous gradation was obtained.

EXAMPLE 8

A silver image was formed on a photographic material as described in Example 1 and then bleached using a bleaching solution having the following composition (20° C, 2 min.).

| Bleaching Solution | |
|---|---|
| Potassium Dichromate | 10 g |
| Hydrochloric Acid (36%) | 5 ml |
| Water to make | 1 liter |

After rinsing in water and drying, the photographic material was heated in air at about 400° C for 5 min., and then sputter etched for 25 min. in the same manner as described in Example 1 to obtain a glass relief pattern having a depth of about 0.5 $\mu$.

EXAMPLE 9

After the bleaching of Example 8, the photographic material was rinsed with water, and the silver halide formed by bleaching reduced to silver using the developer of Example 1. After rinsing with water, the silver image was toned in the same manner as described in Example 5.

After rinsing with water and drying, the photographic material was subjected to sputtering for about 35 min. in the same manner as described in Example 1 to obtain a glass relief pattern having a maximum relief depth of about 0.7 $\mu$.

EXAMPLE 10

The same photographic material as described in Example 1 was obtained except for coating a subbing layer (about 0.1 $\mu$ thick) having the following composition on the glass support using an immersion method and drying for 15 min at 130° C prior to coating the silver bromide photographic emulsion thereon.

Subbing Solution

A solution prepared by adding 0.45 g of nitrocellulose (nitrocellulose RS 1/8; made by Daisel Ltd.) and 10.0 g of acetone while stirring to a gelatin dispersion comprising:

| | |
|---|---|
| Gelatin | 0.4 g |
| Salicylic Acid | 0.12 g |
| Methanol | 0.18 g |
| Ethylene Choride | 55.0 g |
| Acetone | 15.0 g |

and heating the amplitude hologram at about 450° C for about 5 min.

A glass hologram having a diffraction efficiency of about 15% was obtained.

While the invention has been described in detail and with reference to specific embodiments thereof, it will be apparent to one skilled in the art that various changes and modifications can be made therein without departing from the spirit and scope thereof.

What is claimed is:

1. A method for producing a relief pattern comprising in sequence forming one of (i) a silver image, (ii) a silver halide image, and (iii) an image obtained by toning and/or intensifying said silver image in the emulsion layer of a photographic light-sensitive material which comprises a support having thereon at least one silver halide emulsion layer either directly or on at least one subbing layer on the support by image-wise exposure to light and developing; heating said photographic material at a temperature greater than 150° C to thermally decompose the binder of said emulsion layer; and then ion-etching the photographic material to form a relief pattern in the support corresponding to said image.

2. The method of claim 1, wherein said support is a plate or film of glass, a ceramic, a cermet, silica, sapphire, a metal, a semi-metal, a high melting point polymeric substance, a porcelain enamel, a metal coated with a ceramic, a metal having a metal oxide layer thereof, or a combination of two or more thereof.

3. The method of claim 2, wherein said glass is silica glass, soda lime glass, potash glass, borosilicate glass or barium glass, said ceramic is an alumina ceramic, said semi-metal is silicon, germanium, Ga-As, Ga-P, or In-P, and said metal is nickel, copper, cobalt, chromium, aluminum, titanium, gold, platinum, palladium, rhodium, iridium, a nickel-iron alloy, a nickel-chromium alloy, a nickel-cobalt alloy, an aluminum-iron alloy, or a chromium-iron alloy.

4. The method of claim 1, wherein said silver halide emulsion layer comprises silver chloride, silver bromide, silver iodide, silver chlorobromide, silver bromoiodide, silver chlorobromoiodide or a mixture thereof.

5. The method of claim 4, wherein said silver halide emulsion comprises about 90 mole % or more silver bromide and not more than about 5 mole % silver iodide and the mean grain size of the silver halide grains is not more than about 0.1 micron and wherein the weight ratio of the silver halide to the binder of the emulsion is about 1:4 to about 6:1.

6. The method of claim 4, wherein said silver halide emulsion comprises about 50 mole % or more silver chloride and the mean grain size of the silver halide grains is not more than about 1 micron.

7. The method of claim 1, wherein said toning and/or intensification of the silver image is conducted using an aqueous solution of at least one compound containing one element selected from the group consisting of mercury, copper, lead, uranium, selenium, sulfur, iron, nickel, cobalt, vanadium, titanium, chromium, cadmium, gold, platinum, palladium, iridium and rhodium.

8. The method of claim 1, wherein said heating is at above 300° C.

9. The method of claim 1, wherein said ion-etching is sputter etching.

10. The method of claim 1, wherein said image has continuous gradation.

11. The method of claim 1, wherein said ion-etching is carried out until the decomposed emulsion layer is completely removed.

12. The method of claim 1, wherein said support is transparent.

* * * * *